US008002577B1

(12) United States Patent
Sun

(10) Patent No.: US 8,002,577 B1
(45) Date of Patent: Aug. 23, 2011

(54) RJ-45 CONNECTOR

(75) Inventor: Zheng-Heng Sun, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 0 days.

(21) Appl. No.: 12/859,284

(22) Filed: Aug. 19, 2010

(51) Int. Cl.
*H01R 3/00* (2006.01)

(52) U.S. Cl. ..... 439/490; 439/344; 439/352

(58) Field of Classification Search ..... 439/490, 439/344, 352
See application file for complete search history.

(56) References Cited

U.S. PATENT DOCUMENTS

| | | | | |
|---|---|---|---|---|
| 5,741,152 | A * | 4/1998 | Boutros | 439/490 |
| 5,759,067 | A * | 6/1998 | Scheer | 439/607.26 |
| 6,457,992 | B2 * | 10/2002 | Posey et al. | 439/490 |
| 6,520,799 | B1 * | 2/2003 | Cheng et al. | 439/541.5 |
| 6,887,092 | B2 * | 5/2005 | Minota | 439/372 |
| 6,921,284 | B2 * | 7/2005 | Sirichai et al. | 439/490 |
| 7,101,219 | B1 * | 9/2006 | Huang | 439/490 |
| 7,387,527 | B2 * | 6/2008 | Kim et al. | 439/372 |
| 7,717,735 | B2 * | 5/2010 | Yasui | 439/490 |
| 7,785,135 | B2 * | 8/2010 | Wu | 439/490 |
| 7,811,120 | B2 * | 10/2010 | Liu | 439/490 |
| 7,837,511 | B2 * | 11/2010 | Hsu | 439/669 |
| 7,922,519 | B1 * | 4/2011 | Sun | 439/490 |
| 2001/0039140 | A1 * | 11/2001 | Fasold et al. | 439/490 |
| 2002/0009910 | A1 * | 1/2002 | Posey et al. | 439/131 |
| 2005/0003696 | A1 * | 1/2005 | Shirk et al. | 439/352 |
| 2007/0155223 | A1 * | 7/2007 | Huang et al. | 439/490 |
| 2007/0259573 | A1 * | 11/2007 | Machado et al. | 439/676 |
| 2009/0061676 | A1 * | 3/2009 | Yasui | 439/490 |

* cited by examiner

*Primary Examiner* — T C Patel
*Assistant Examiner* — Vladimir Imas
(74) *Attorney, Agent, or Firm* — Zhigang Ma

(57) ABSTRACT

A connector includes a main body, a reflecting member, and a cable electrically connected to a rear end of the main body. An elastic latch is formed on a top of the main body opposite to the cable. The reflecting member is fitted to a rear portion of the main body, and two protrusions are formed on a top of the reflecting member. A surface of each protrusion is coated with reflective material, slanted, and opposite to the cable.

15 Claims, 3 Drawing Sheets

RJ-45 CONNECTOR

CROSS-REFERENCE OF RELATED APPLICATIONS

Relevant subject matter is disclosed in a co-pending U.S. patent application, titled "RJ-45 CONNECTOR," with the application Ser. No. 12/825,339, and in a co-pending U.S. patent application, entitled "RJ-45 connector," with the application Ser. No. 12/854,312, which are assigned to the same assignee as this patent application.

BACKGROUND

1. Technical Field

The present disclosure relates to a Registered Jack-45 (RJ-45) connector.

2. Description of Related Art

RJ-45 connectors are widely used in network communication. In use, an RJ-45 connector is engaged in an interface of a chassis of a computer or a server. The interface includes two light emitting diodes, used to indicate whether the network connection is working properly. However, in most cases, the interface is defined in a rear end of the chassis, thus light generated by the light emitting diodes is only seen from the back of the chassis, which is inconvenient.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure, including the accompanying drawings, is illustrated by way of example and not by way of limitation. It should be noted that references to "an" or "one" embodiment in this disclosure are not necessarily to the same embodiment, and such references mean at least one.

Figure 1:
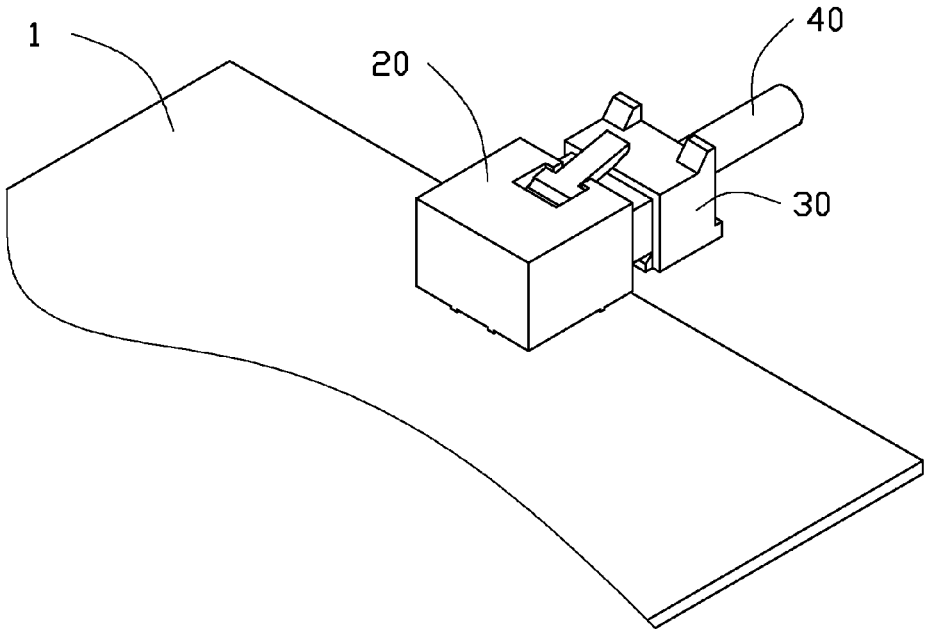
FIG. 1 is an assembled, isometric view of one embodiment of a Registered Jack-45 (RJ-45) connector and a motherboard mounted with a connector, the RJ-45 connector including a reflecting member.
Figure 2:
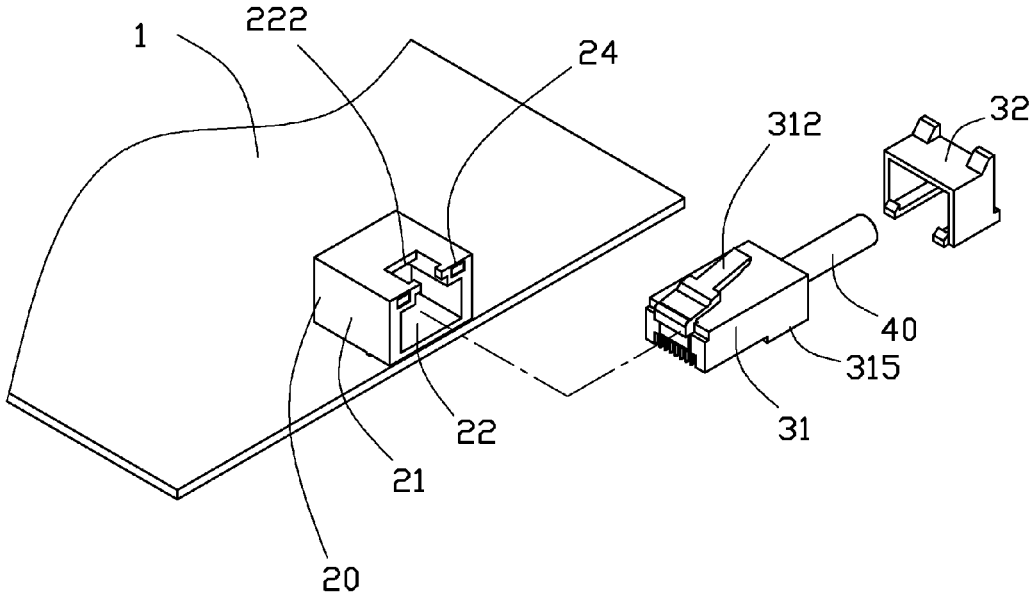
FIG. 2 is an exploded, isometric view of FIG. 1, but viewed from another perspective.

Referring to FIG. 1 and FIG. 2, an embodiment of a Registered Jack-45 (RJ-45) connector 30 includes a main body 31, a reflecting member 32 fitting about a rear end of the main body 31, and a cable 40 extending from the rear end.

An elastic latch 312 is formed on a front end of the main body 31 opposite to the rear end. A raised portion 315 is formed on a bottom of the rear end of the main body 31.

Figure 3:
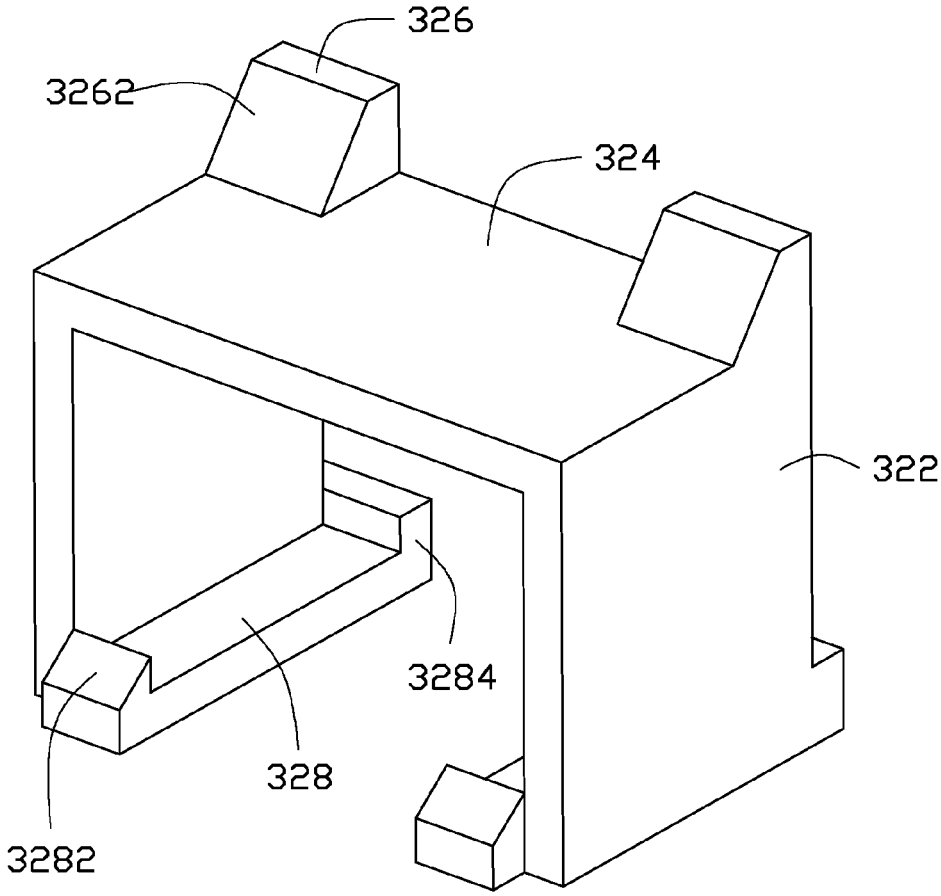
FIG. 3 is an enlarged view of the reflecting member of FIG. 2.

Referring to FIG. 3, the reflecting member 32 can be substantially U-shaped and includes opposite sidewalls 322, and a connecting portion 324 connected between tops of the sidewalls 322. Two wedge-shaped protrusions 326 are formed on a top surface of the connecting portion 324. Each protrusion 326 has a slanted surface 3262 coated with a reflective material, such as mirrored glass, or shiny fabric or film.

A latch portion 328 is formed on a bottom of each sidewall 322, and extends substantially perpendicularly from the corresponding sidewall 322 towards the other sidewall 322. Each latch portion 328 includes a first blocking portion 3282 and a second blocking portion 3284 extending towards the connecting potion 324 from a front end and a rear end of the latch portion 328. The first blocking portions 3282 can be wedge-shaped and include a slanted top surface 3283 away from the corresponding second blocking portion 3284.

In assembly, the main body 31 is inserted into a receiving space formed by the sidewalls 322 and the connecting portion 324 through the front end of the reflecting member 32. The raised portion 315 rides along the slanted top surfaces 3283 of the first blocking portions 3282, and is positioned between the first and second blocking portions 3282 and 3284. Opposite sides of the raised portion 315 respectively abut against the first blocking portions 3282 and the second blocking portions 3284. Thus, the reflecting member 32 is fitted about the rear portion of the main body 31.

Referring to FIG. 2 again, the RJ-45 connector 30 can be inserted into a connector 20 of a motherboard 1. The connector 20 includes a housing 21 defines a receiving space 22. An opening 222 is defined in a top of the housing 21, communicating with the receiving space 22. Two light emitting diodes 24 are positioned at opposite sides of the opening 222 and face the RJ-45 connector 30.

Referring to FIG. 1 again, in assembly, the connector 30 is inserted into the receiving space 22 of the connector 20. The elastic latch 312 is engaged in the opening 222. The slanted surface 3262 of each protrusion 326 substantially faces a corresponding light emitting diode 24 and reflects light generated by the corresponding light emitting diode 24. Thereby, the light can be seen from other aspects easily.

It is believed that the present embodiments and their advantages will be understood from the foregoing description, and they will be apparent that various changes may be made thereto without departing from the spirit and scope of the description or sacrificing all of their material advantages, the examples hereinbefore described merely being exemplary embodiment.

What is claimed is:

1. A Registered Jack-45 (RJ-45) connector matching another connector having at least one light emitting diode, the RJ-45 connector comprising:

a main body to be engaged with the another connector; and a reflecting member detachably mounted on the main body, the reflecting member comprising at least one protrusion extending from a top thereof, wherein a surface of each of the at least one protrusion is coated with a reflective material, slanted, and operable to substantially face the at least one light emitting diode when the RI-45 connector is connected with the another connector.

2. The RJ-45 connector of claim 1, wherein the at least one light emitting diode of the another connector comprises two light emitting diodes, the at least one protrusion of the reflecting member comprises two protrusions extending from a top thereof, a surface of each of the two protrusions is operable to substantially face a corresponding one of the two light emitting diodes when the RI-45 connector is connected with the another connector.

3. The RJ-45 connector of claim 1, wherein the reflecting member is substantially U-shaped and comprises two opposite sidewalls and a connecting portion connected between tops of the sidewalls, the sidewalls and the connecting portion bounding a receiving space thereamong to receive the main body.

4. The RJ-45 connector of claim 3, wherein the main body further comprises a raised portion formed on a bottom of a rear end of the main body, and the reflecting member further comprises at least one latch portion formed inward from a bottom of each of the sidewalls, to engage with the at least one raised portion.

5. The RJ-45 connector of claim 4, wherein the number of the at least one latch portion is two, and each latch portion protrudes substantially perpendicularly from a corresponding one of the sidewalls towards the other one of the sidewalls.

6. The RJ-45 connector of claim 5, wherein each latch portion comprises a first blocking portion and a second blocking portion positioned on a front end and a rear end of the latch portion, the raised portion is positioned between the first and second blocking portions, and opposite sides of the raised portion respectively abut against the first blocking portions and the second blocking portions.

7. The RJ-45 connector of claim 6, wherein each first blocking portion is wedge-shaped and comprises a slanted surface away from a corresponding second blocking portion.

8. The RJ-45 connector of claim 3, wherein the at least one protrusion extends up from the connecting portion of the reflecting member.

9. The RJ-45 connector of claim 1, wherein the reflective material is mirrored glass, or shiny fabric or film.

10. The RJ-45 connector of claim 1, further comprising a cable extending from a rear end of the main body.

11. The RJ-45 connector of claim 10, wherein the main body further comprises an elastic latch formed on a front end of the main body to engage with the connector.

12. A Registered Jack-45 (RJ-45) connector assembly comprising:

a first connector defining a first receiving space, and comprising at least one light emitting diode; and a second connector comprising a main body and a reflecting member detachably mounted on the main body to be received in the first receiving space together with the main body, the reflecting member comprising at least one protrusion extending from a top thereof, wherein a surface of each of the at least one protrusion is coated with a reflective material, slanted, and operable to substantially face the at least one light emitting diode when the second connector is connected with the first connector.

13. The RJ-45 connector assembly of claim 12, wherein the at least one light emitting diode of the first connector comprises two light emitting diodes at opposite sides of the first receiving space, the at least one protrusion of the reflecting member of the second connector comprises two protrusions extending from a top thereof, a surface of each of the two protrusions is operable to substantially face a corresponding one of the two light emitting diodes when the second connector is connected with the first connector.

14. The RJ-45 connector assembly of claim 12, wherein the first connector further defines an opening communicating with the first receiving space; an elastic latch is formed on the main body of the second connector to engage in the opening.

15. The RJ-45 connector assembly of claim 12, wherein the reflecting member is substantially U-shaped and comprises two opposite sidewalls and a connecting portion connected between tops of the sidewalls, the sidewalls and the connecting portion bounding a second receiving space to receive the main body.

* * * * *